United States Patent [19]

Jackson et al.

[11] Patent Number: 4,774,023

[45] Date of Patent: Sep. 27, 1988

[54] ELECTRO-CONDUCTIVE ELASTOMERIC MATERIALS

[75] Inventors: John Jackson, Lesmahagow; Seyed A. Angadjivand, Glasgow, both of Scotland

[73] Assignee: University of Strathclyde, Glasgow, Scotland

[21] Appl. No.: 821,281

[22] Filed: Jan. 22, 1986

[30] Foreign Application Priority Data

Jan. 29, 1985 [GB] United Kingdom ..... 8502204

[51] Int. Cl.[4] ..... H01B 1/06

[52] U.S. Cl. ..... 252/511; 252/510; 264/105; 264/347; 264/331.11

[58] Field of Search ..... 252/510, 511; 524/474, 524/588, 495, 496; 264/105, 299, 331.11, 330, 347

[56] References Cited

U.S. PATENT DOCUMENTS 4,505,847 3/1985 Jackson ..... 252/511

4,533,604 8/1985 Honda et al. ..... 252/510

*Primary Examiner*—Josephine Barr

*Attorney, Agent, or Firm*—Bell, Seltzer, Park & Gibson

[57] ABSTRACT

A method of manufacturing an electro-conductive elastomeric material comprises mixing together silicone polymer gum, graphitic carbon particles, curing and cross-linking agents in the presence of an oil having a carbon chain length of at least 16 and having a high degree of mesogenicity, together with a volatile additive in which the oil and gum dissolve and/or disperse miscibly. The volatile additive may be Toluene, Chloroform, Tetrahydrofuran, n-Hexane or SBP3.

9 Claims, 2 Drawing Sheets

ELECTRO-CONDUCTIVE ELASTOMERIC MATERIALS

This invention relates to electro-conductive elastomeric materials, and to methods of production thereof.

In our EPC Patent Specification No. 89843 there are disclosed various electro-conductive elastomeric materials formulated from a silicone polymer gum (which is nonconductive), graphitic carbon particles (which are conductive) and unsaturated glyceride oils having a carbon chain length of at least 16 and a high degree of mesogenicity (i.e. ability to flex around the molecular bonds). Whilst the physical and electrical properties of these disclosed materials are adequate for the purposes proposed in that Patent Specification it has been considered desirable to enhance these characteristics and to render production of these materials less dependent upon stringent manufacturing tolerances.

According to the present invention a method of manufacturing an electro-conductive elastomeric material comprises mixing together silicone polymer gum, graphitic carbon particles, curing and crosslinking agents in the presence of an oil having a carbon chain length of at least 16 and a high degree of mesogenicity, and a volatile additive in which the oil and gum dissolve and/or disperse miscibly.

It will be appreciated that the aforesaid additive is a solvent and/or dispersal agent for the oil and the silicone polymer gum providing a homogeneous mixture of these components and the additive is itself volatile so that during vulcanisation or curing of the gum the additive escapes by volatilisation from the mixture and carries off air, water vapour and other gaseous substances formed during mixing or curing of the mixture. Preferably the rate of volatilisation equates to the rate of curing.

By way of example the additive may be any one of the solvents and/or dispersal agents: toluene; chloroform; tetrahydrofuran (THF); n-Hexane; or SBP3 (which is made by ICI and sold under this designation which is believed to represent 'Special Boiling Point No. 3')

By virtue of the aforesaid additive the resultant electro-conductive elastomeric material demonstrates reduced volume resistivity, increased strain limit, reduced physical and electrical hysteresis characteristics when compared with materials manufactured in the absence of the additive. Furthermore the improved characteristics are achieved without close control of the duration of mixing. For example mixing may endure for as little as 5 or 10 minutes. Also, mixing is more easily achieved because it is less viscous and the mixture produced at the end of mixing is less viscous and therefore more controllable for casting purposes. The additive may be present in the mixture in varying amounts to obtain the enhanced characteristics from trace quantities relative to the quantities of gum and oil and it has been found, for example, that the volume resistivity of the electro-conductive material is reduced tenfold by quantities of as little as 40 ml per 120 gm of gum and oil. It has also been found that the tensile strength of the material is approximately doubled for quantities of the additive of as little as 60 ml per 120 gm of gum and oil. In each instance 70 gm of graphitic carbon was present. Furthermore minimum electrical and physical hysteresis was obtained at a predetermined amount of the additive.

It is preferred that the method of the present invention be undertaken by initially mixing together the silicone polymer gum, the crosslinking agent, the oil and the additive and thereafter adding to the resultant premixture the graphitic carbon, undertaking further mixing, subsequently adding the curing agent and mixing this in, and thereafter curing the resultant mixture. Conveniently, however, at the step of adding the graphitic carbon a further quantity of the additive is entered into the premixture to enhance dispersion of the graphitic carbon.

It will be understood that the graphitic carbon is in powder form with particle sizes of the order of microns conveniently, but not essentially, having a maximum size of the order of 50 microns.

The silicone polymer gum may incorporate fillers such as calcium carbonate or fumed silica, the quantum of filler being varied to provide different viscosities to the resultant material. By way of example the polymer gum may be a room temperature vulcanizing silicone rubber such as that available from J-Sil Silicones (UK) Ltd. under the designation C2001, C2501 or may be unfilled gum such as Silicone Sealant Polymers (each of which is made and sold by ICI) designated A - product code 11637; B-product code 11636; C-product code 11635; D-product code 11632. These gums are all dihydroxy-polydimethylsiloxanes and provide different mean molecular weights to the resultant material. A convenient curing agent is DBTL (di-butyl-tin-dilaurate); and a convenient crosslinking agent is Silester O.S. produced by Monsanto, which is a mixture of tetraethyl orthosilicates and ethyl polysilicates.

The oil may conveniently be a triglyceride such as an unsaturated vegetable oil having a carbon chain length of 16 or greater various examples of which are disclosed in the aforesaid Patent Specification or it may be a synthetic or other naturally occurring oil having a similar degree of mesogenicity to the aforesaid vegetable oils whether triglyceride, di-glyceride or otherwise. Embodiments of the present invention will now be described by way of example with reference to the accompanying drawings, in which.

Figure 1:
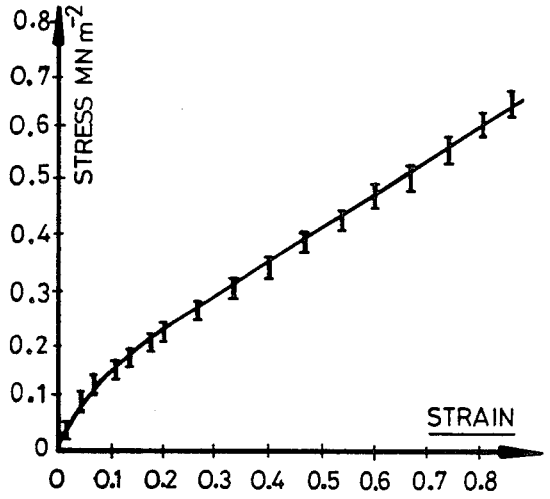
FIG. 1 illustrates the stress/strain characteristics of an exemplary electro-conductive material in accordance with the present invention.
Figure 4A:
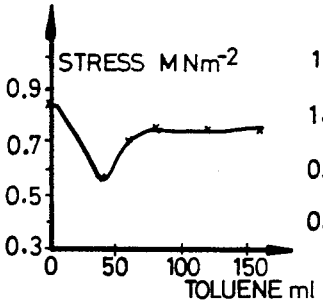
Figure 4B:
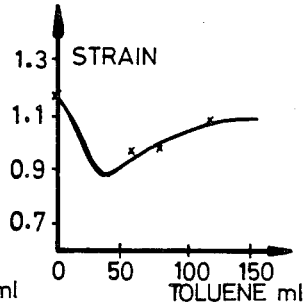
Figure 4C:
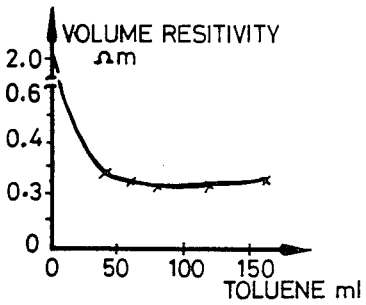
Figure 5:
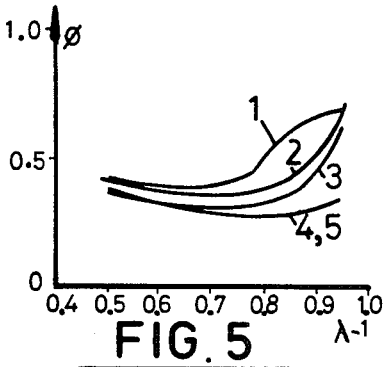

FIG. 4A, FIG. 4B and FIG. 4C are respective plots of Stress, Strain, and Volume Resistivity of electro-conductive materials when the quantum of a particular volatile additive in the material is varied; and FIG. 5 illustrates Mooney Plot characteristics of electro-conductive materials in accordance with the present invention when the quantum of a particular volatile additive in the material is varied. A series of typical electro-conductive materials formed in accordance with the present invention from a mixture comprising 100 g silicone polymer gum (C2501), 100 ml of a volatile additive, namely toluene, 70 g graphite and various amounts of arachis oil (10 to 30 g) were vulcanised at room temperature using 2 g of DBTL as curing agent and 5 g of Silester O.S. crosslinker. The ultimate tensile strength, percentage elongation at break, and volume resistivity characteristics of these materials are given in Table 1 and a stress/strain plot for an exemplary one of these materials (namely 20 g arachis oil) is shown in FIG. 1.

Using the data from the stress/strain plots of the various materials, a Mooney Plot (FIG. 2) of F/A $(\lambda-\lambda^{-2})$ against $\lambda^{-1}$ was derived, where F is the force, A =cross sectional area and elongation $\lambda = l/l_o$ where l and lo are the lengths of the tested sample in the deformed and undeformed states respectively.

It will be appreciated that a Mooney Plot is a well known technique for representing the physical characteristics of an elastomeric material and the ordinate axis (Y-axis) denotes the function $\phi$ where $$\phi = \frac{\text{Force } (F)}{\text{Area of } X\text{-Sec } (A) \times (\lambda - \lambda^{-2})}$$

whilst the abscissa (X-Axis) denotes the function $$\lambda^{-1} = lo/l$$

When the slope of the Mooney Plot is parallel to the X-axis there is no hysteresis. $\phi$ is representative of resistance to extension.

Figure 2:
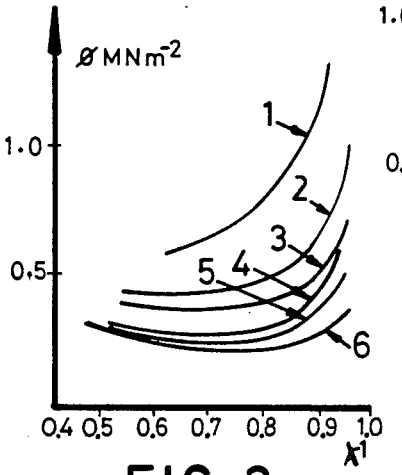
FIG. 2 illustrates the Mooney Plot characteristics of electro-conductive materials in accordance with the present invention when the oil content of the material is varied.

From FIG. 2 wherein graph 1 is for 10 g arachis oil, graph 2 is for 15 g arachis oil, graph 3 is for 20 g arachis oil, graph 4 is for 22 g arachis oil, graph 5 is for 25 g arachis oil and graph 6 is for 30 g arachis oil, it can be deduced that, when 10 g of arachis oil was used in the material, poor physical properties result. When the amount of arachis oil was increased the physical properties of the materials were improved, and about 20 to 22 g was found to be the quantity of arachis oil for optimal physical properties. The material was excess in oil on its surface, when greater than 30 g of arachis oil was added, and the physical properties of the material were poorer and also difficult to work with.

The effect of different volatile additives was evaluated from materials formed of 100 g polymer B silicone gum, 70 g graphitic carbon, 20 g arachis oil, 5 g crosslinker, 2 g DBTL curing agent and 160 ml of the volatile additive. The additives were Toluene, Chloroform, Special Boiling Point No. 3, n-Hexane, and Tetrahydrofuran and the characteristics of the resultant materials are shown in Table II and in the Mooney Plots of FIG. 3 where graph 1 is for Toluene, graph 2 is for Chloroform, graph 3 is for Tetrahydrofuran, graph 4 is for n-Hexane, and graph 5 is for Special Boiling Point No. 3. From these characteristics Toluene has been identified as providing the optimal combination of volume resistivity, strain limit and hysteresis characteristics. Accordingly Toluene was applied in varying amounts to a further trial mixture formed by 100 g C2501 Silicone polymer gum, 70 g graphitic carbon particles, 20 g arachis oil, 5 g Silester O.S. crosslinker and 2 g DBTL curing agent and the resultant characteristics, as a function of quantum of the additive, are denoted in Table III and illustrated in FIGS, 4A, 4B and 4C; the Mooney Plot being shown in FIG. 5 wherein graph 1 is for zero Toluene, graph 2 is for 60 ml Toluene, graph 3 is for 80 ml Toluene, graph 4 is for 120 ml Toluene, and graph 5 is for 160 ml Toluene.

Figure 3:
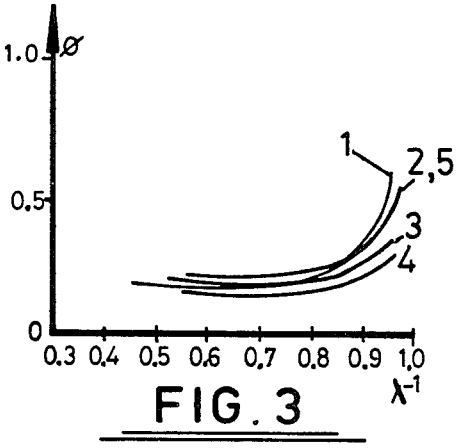
FIG. 3 illustrates Mooney Plot Characteristics Of electro-conductive materials in accordance with the present invention when the volatile additive in the material is varied.

The significance of volatile additives is clearly demonstrated by FIGS. 3, 4 and 5 and the related Tables. Thus the presence of the volatile additive reduces volume resistivity of the electro-conductive material and, in the case of Toluene (as shown in FIG. 4C), this occurs even at relatively small quantities (of the order of 50 ml). Further, it is clear that an amount of Toluene of the order of 70 ml produces minimum hysteresis and low volume resistivity whilst retaining good tensile properties (stress is shown in FIG. 4A, strain is shown in FIG. 4B). At Toluene quantities of 80 ml and greater (within the limits of experimental evidence) the properties of the material remain substantially constant.

In order to obtain the foregoing elastomeric materials incorporating the volatile additive in accordance with the present invention a typical procedure was as follows:

The required amount of oil was added to 100 g of silicone polymer gum (C2501); followed by 100 ml of toluene and 5 g of crosslinker. The mixture was allowed to mix by a rotating shear mixer for about 5 minutes. Later 70 g of graphite powder was added to the mixture and further 50 ml of toluene (to give a good dispersion of graphite in the mixture) and mixing was carried out for a further 5 to 10 minutes. Finally at the end of mixing 2 g of DBTL (di-butyl-tin-dilaurate) was added. The resultant material was cast and left to set. No testing on the material was carried out for at least 24 hours after setting. A minimum of 4 samples from each such material was then tested for the volume resistivity and the stress/ strain measurement.

TABLE I

| Arachis Oil g | Ultimate Tensile Strength M $Nm^{-2}$ | % Elongation at break | Volume Resistivity Ωm |
|---|---|---|---|
| 10 | 0.77 | 68 | 0.079 |
| 15 | 0.71 | 86 | 0.081 |
| 20 | 0.65 | 87 | 0.073 |
| 22 | 0.65 | 116 | 0.080 |
| 25 | 0.62 | 112 | 0.083 |
| 30 | 0.51 | 93 | 0.11 |

TABLE II

| Additive | Ultimate Tensile Strength M $Nm^{-2}$ | % Elongation at break | Volume Resistivity Ωm |
|---|---|---|---|
| Toluene | 0.372 | 120 | 0.71 |
| Chloroform | 0.323 | 86 | 0.35 |
| Special Boiling Point No. 3 | 0.37 | 97 | 0.81 |
| n-Hexane | 0.317 | 93 | 0.90 |
| Tetrahydrofuran | 0.347 | 93 | 1.18 |

TABLE III

| Toluene ml | Ultimate Tensile Strength M $Nm^{-2}$ | % Elongation at break | Volume Resistivity Ωm |
|---|---|---|---|
| 0 | 0.831 | 117 | 2.08 |
| 40 | 0.561 | 87 | 0.28 |
| 60 | 0.711 | 96 | 0.25 |
| 80 | 0.738 | 97 | 0.23 |
| 120 | 0.730 | 107 | 0.25 |
| 160 | 0.732 | 109 | 0.27 |

What is claimed is:

1. A method of manufacturing a cured and cross-linked silicone polymer electro-conductive material comprising the steps of selecting as constituents for the electro-conductive material:

silicon polymer gum; graphitic carbon particles; curing and cross-linking agents; an oil having a carbon chain length of at least 16 and a high degree of mesongenicity; and a volatile additive in which the oil and gum dissolve miscibly;

forming an intimately mixed admixture of said constituents, and subsequently subjecting the admixture to settled conditions over a predetermined time interval to effect cross-linking of the gum and curing of the admixture, the volatile additive being volatilised off during the curing process.

2. A method as claimed in claim 1, wherein the constituents of the admixture are quantitatively selected so that the rate of volatilisation of said additive substantially equates with the rate of curing of the admixture.

3. A method as claimed in claim 1, wherein the silicone polymer gum, the cross-linking agent, the oil and the volatile additive are initially mixed together to form a premixture, and the graphitic carbon particles and curing agnets are subsequently added to and mixed in with the premixture in order to form said admixture.

4. A method as claimed in claim 3, wherein the premixture contains only a portion of the volatile additive the remainder of which is added to the premixture in combination with the graphitic carbon particles.

5. A method as claimed in claim 1, whrein the volatile additive is selected from the group comprising Toluene, Chloroform, Tetrahydrofuran, and n-Hexane.

6. A method as claimed in claim 4, wherein the volatile additive is Toluene in the amount of at least 50 ml per 100 g silicone polymer gum.

7. A method as claimed in claim 1, wherein the mixture comprises 100 g silicone polymer gum, 70 g graphitic carbon particles, 5 g crosslinker, 2 g DBTL curing agent, 20 g arachis oil and 70 ml toluene.

8. An electro-conductive elastomeric material when made by the method claimed in claim 1.

9. A method of manufacturing a cured and cross-linked silicone polymer electro-conductive material comprising the steps of selecting as constituents for the electro-conductive material:

silicon polymer gum; graphitic carbon particles; curing and cross-linking agents; an oil having a carbon chain length of at least 16 and a high degree of mesogenicity; and a volatile additive in which the oil and gum disperse miscibly;

forming an intimately mixed admixture of said constituents, and subsequently subjecting the admixture to settled conditions over a predetermined time interval to effect cross-linking of the gum and curing of the admixture, the volatile additive being volatilised off during the curing process.

* * * * *